United States Patent [19]

Woods et al.

[11] 3,958,781

[45] May 25, 1976

[54] TRAIN VEHICLE PROTECTION APPARATUS INCLUDING SIGNAL BLOCK OCCUPANCY DETERMINATION

[75] Inventors: David H. Woods, Pittsburgh, Pa.; Lawrence W. Anderson, Sao Paulo, Brazil

[73] Assignee: Westinghouse Electric Corporation, Pittsburgh, Pa.

[22] Filed: Jan. 29, 1975

[21] Appl. No.: 545,231

[52] U.S. Cl. ..... 246/34 R; 340/38 R

[51] Int. Cl.[2] ..... B61L 21/06

[58] Field of Search ..... 246/34 R, 34 CT, 182 R, 246/63 C; 340/38 R

[56] References Cited

UNITED STATES PATENTS

| | | | |
|---|---|---|---|
| 2,959,670 | 11/1960 | Kendall | 246/63 C |
| 3,450,874 | 6/1969 | Whitten | 246/34 CT |
| 3,489,892 | 1/1970 | Whitten | 246/34 CT |
| 3,532,877 | 10/1970 | Thorne-Booth | 246/34 CT |

*Primary Examiner*—Trygve M. Blix
*Assistant Examiner*—Reinhard J. Eisenzopf
*Attorney, Agent, or Firm*—R. G. Brodahl

[57] ABSTRACT

There is disclosed a train vehicle protection apparatus including the determination of train vehicle occupancy of a track circuit signal block, wherein a frequency tone speed code signal is provided to the signal block for controlling the train vehicle speed and a vital and fail-safe determination of train vehicle occupancy of the signal block is provided.

7 Claims, 14 Drawing Figures

TRAIN VEHICLE PROTECTION APPARATUS INCLUDING SIGNAL BLOCK OCCUPANCY DETERMINATION

CROSS-REFERENCE TO RELATED PATENT APPLICATION

The present invention is related to the invention covered by a related patent application entitled "Vehicle Presence Detection In A Vehicle Control System" by R. H. Perry, now issued as U.S. Pat. No. 3,891,167 and assigned to the same assignee.

BACKGROUND OF THE INVENTION

It is well known in the prior art train vehicle control system operation to compare a transmitted digital speed code signal with a received digital speed code signal in relation to vehicle occupancy determination in a defined track circuit signal block to which that speed code signal is supplied, for controlling the speed of a train vehicle present within that signal block. It is also well known to supply frequency tone speed code signals to a track circuit signal block to control the movement speed of train vehicle within that signal block, with a particular frequency tone being supplied to the signal block for the open loop control of the desired speed of a train vehicle moving within that signal block.

The BART automatic train control system as described in an article published in the September 1972 Westinghouse Engineer at pages 145–151, transmitted a digital speed code signal to one end of a predetermined track circuit signal block and that same digital speed code signal was received at the opposite end of the signal block for the purpose of detecting signal block occupancy by a train vehicle. For this purpose the received speed code signal was compared with the transmitted original speed code signal.

In other prior art train vehicle control systems, where there is no multiplex signaling system and no digital bits of speed code signals, there is provided a unique frequency tone or carrier frequency for controlling the speed of the train vehicles. There is no digital signal that can be compared, and the frequency tone amplitude modulates a carrier frequency signal to be either ON or OFF on a full 100% modulated basis.

When transmitting speed code signals into the track of a steel wheel and steel rail system, it is well known to compare at some point the speed code signal that is sent with that received within a track circuit signal block or zone. This comparison serves to establish whether or not the signal block is occupied by a train vehicle and in addition, by comparing the speed code signal, safety is increased by virtually eliminating the likelihood of receiving the same speed code signal from an adjacent signal block when a particular signal transmitter fails or track bonds become broken, which condition can be dangerous since a valid train vehicle occupancy may not be detected as such. In addition, it is known to employ frequency separation to separate the speed code signals in relation to adjacent signal blocks, as described in U.S. Pat. No. 3,532,877 of G. M. Thorne-Booth, which discloses a serial six-bit speed code signal and the received speed code signal is compared bit by bit with the transmitted speed code signal.

In a train vehicle control situation where serial bit speed code signals are not utilized, the conventional method of frequency tone coded speed code signals is used.

SUMMARY OF THE PRESENT INVENTION

A frequency tone speed code signal for controlling the movement speed of a train vehicle is supplied to a given track circuit signal block and is received from that same signal block, with the train vehicle occupancy of that signal block being determined by a provided signal comparison operation which establishes that the proper frequency tone speed code signal is in face present in the signal block. If the supplied speed code signal is not received, for the making of this comparison operation, a vehicle occupancy condition is indicated to protect against another train vehicle entering the same signal block. Each of these supplied speed code signal and the received speed code signal is converted into an analog representative signal for comparison in a high gain summing operational amplifier to determine the provision of an alternating current output signal for energizing a vital relay device operative with a speed signal encoder. The signal encoder determines the provision of the supplied speed code signal to the signal block.

DETAILED DESCRIPTION OF A PREFERRED EMBODIMENT

Figure 1:
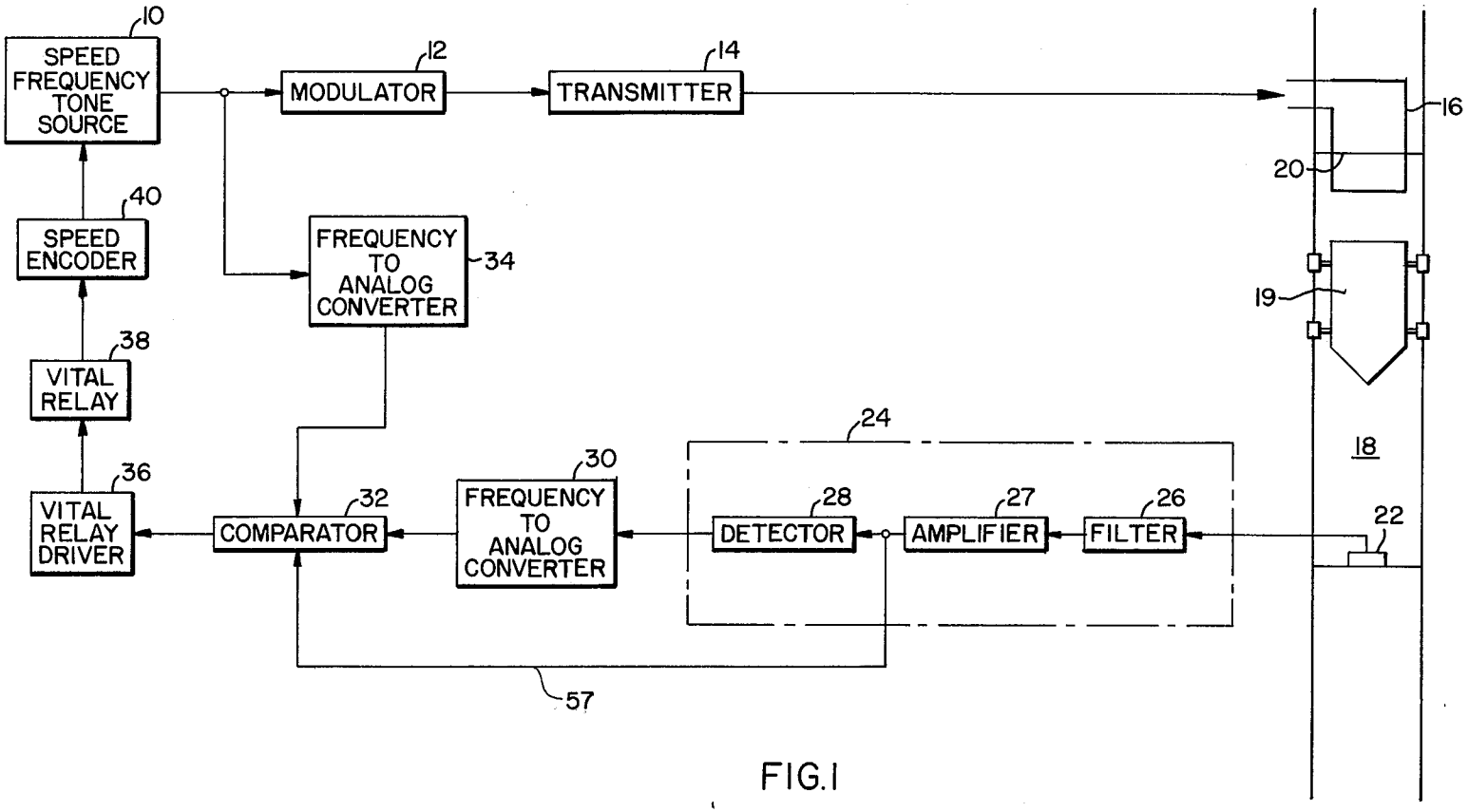
In FIG. 1 there is provided a schematic diagram of the train vehicle protection apparatus in accordance with the present invention.

In FIG. 1 a speed frequency tone source 10 supplies a speed tone code signal to a modulator 12 which then amplitude modulates the output carrier of the transmitter 14 for supply to the antenna 16 and the track circuit signal block 18 including a train vehicle 19. The antenna 22 receives the speed code signal from the signal block 18 and passes it to a receiver 24 including a vital filter 26 which is a well known band pass filter. The output signal from the filter 26 is supplied through an amplifier 27 to a detector 28 and then a frequency to analog converter 30 and one input of a comparator 32. The frequency tone signal from the speed frequency tone source 10 is also applied through a frequency to analog converter 34 to a second input of the comparator 32. The modulating carrier signal is supplied from the output of the amplifier 27 to a third input of the comparator 32, such that when the frequency tone signal from the speed frequency tone source 10 substantially compares with the frequency tone signal from the receiver 24, the comparator 32 provides an alternating current output signal through a vital realy device 36 to operate a vital relay 38 for providing an unoccupied train vehicle indication to the speed encoder 40 such that the normal desired speed code signal to the signal block 18 is then provided. On the other hand if the frequency tone from the speed frequency tone source 10 applied to one input of the comparator 32 does not compare with the frequency tone signal from the receiver 24, the comparator 32 does not provide the alternating current output signal to the vital relay driver 36 such that the vital relay 38 provides an occupied indication in relation to the signal block 18 and the speed encoder 40 causes the speed frequency tone source 10 to provide a zero speed signal to the signal block 18.

Figure 2:
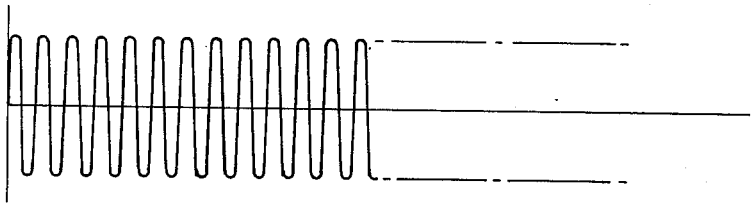
FIG.2 PRIOR ART
In FIG. 2 there is illustrated a prior art speed code signal carrier waveform.
Figure 3:
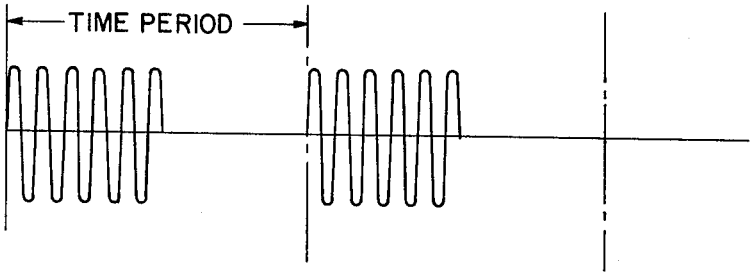
FIG.3 PRIOR ART
In FIG. 3 there is illustrated a prior art speed code signal carrier waveform that is amplitude modulated by a first speed control tone frequency.
Figure 4:
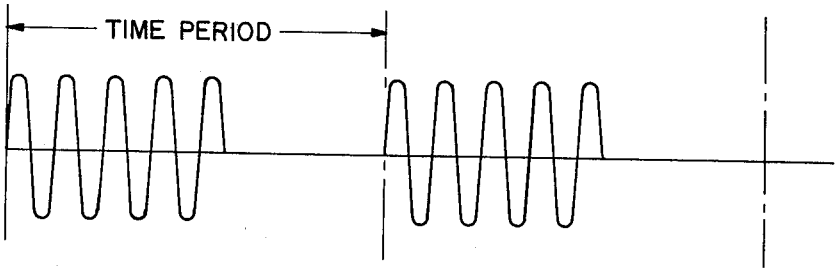
FIG.4 PRIOR ART
In FIG. 4 there is illustrated a prior art speed control signal carrier waveform that is amplitude modulated by a second speed control tone frequency.

In FIG. 2 there is shown a prior art unmodulated continuous wave carrier signal such as used for train control purpose, which is practice has a frequency in the order of 990 hertz. In FIG. 3 there is shown an example of the carrier wave such as shown in FIG. 2 that is amplitude modulated by a first frequency tone signal having an indicated time period in the order of 0.1 seconds. If it is amplitude modulated 100% as shown in FIG. 3, the resulting time period of the coded signal is decoded to determine the frequency tone signal supplied to the train vehicle for controlling the train vehicle speed. In FIG. 4 there is shown an example of the carrier signal shown in FIG. 2 that is amplitude modulated by a frequency tone having a greater indicated time period in the order 0.15 seconds. The first signal shown in FIG. 3 has a higher modulation frequency tone with a shorter time period, and the second signal shown in FIG. 4 has a lower modulation frequency tone with a longer time period. It is presently well known to provide for this purpose, for example, a typical group of six speed code modulating frequency tones could be as follows: (1) 5.0 hertz for a desired vehicle speed of zero cuttout, (2) 6.6 hertz for a desired vehicle speed of 15 mph, (3) 8.6 hertz for a desired vehicle speed of 25 mph, (4) 10.8 hertz for a desired vehicle speed of 35 mph, (5) 13.6 hertz for a desired vehicle speed of 50 mph, and (6) 16.8 hertz for a desired vehicle speed of 70 mph.

The speed code signal transmitted to a particular track circuit signal block will include the carrier signal shown in FIG. 2 of 990 hertz, modulated 100% at the above specific rate in accordance with desired speed control of the train vehicles within that signal block.

The track includes continuous welded rail, with shorting bars at the respective ends of each signal block, and each defined signal block will be end fed with the desired speed code signal. Propulsion current return will be through both running track rails, and the rail currents are to be maintained nominally equal by track circuit signal block defining shunt members. The signal block lengths will on the average be about 450 feet long, with a minimum of 100 feet and a maximum in the order of 1500 feet.

Figure 5:
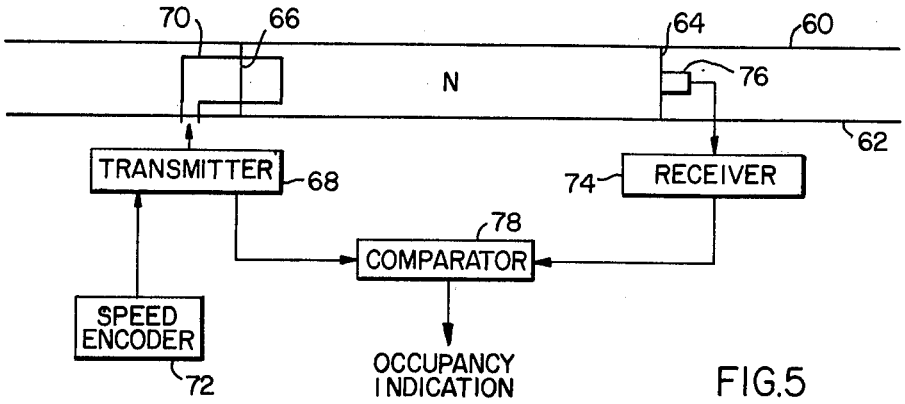
FIG.5 PRIOR ART
In FIG. 5 there is illustrated a prior art train vehicle speed control and occupancy detection apparatus operative with a track circuit signal block.

In FIG. 5 there is shown a track circuit signal block arrangement including track rails 60 and 62 with shunt members 64 and 66 defining a signal block N. A signal transmitter 68 is operative with an antenna 70 coupled with the shunt 66 for providing a desired speed code signal into the signal block N. A speed encoder 72 is operative with the transmitter 68 to determine the modulating frequency tone combined with the carrier supplied by the transmitter 68. A receiver 74 is operative with the antenna 76 coupled with the shunt 64 to sense the speed code signal provided within signal block N. The comparator 78 is operative with the transmitter 68 to sense the transmitted speed code signal and is operative with the receiver 74 to sense the received speed code signal, and if these do not satisfactorily compare than a vehicle is considered to occupy the signal block N. In effect, a train vehicle is providing a low impedance short circuit between the track rails 60 and 62 such that the receiver 74 does not sense a provided speed code signal having a minimum predetermined magnitude.

The present invention provides an improved train vehicle speed control operation. The transmitter 68 includes a 990 hertz carrier, with an amplitude modulated speed code frequency tone signal to determine the train vehicle speed within the track circuit signal block N. To determine if the signal block N is occupied, the transmitted frequency tone coded signal is supplied to the comparator 78 for a comparison to be made in relation with the received signal supplied to the comparator 78 to determine the provision of an occupancy indication signal for signal block N.

Figure 6:
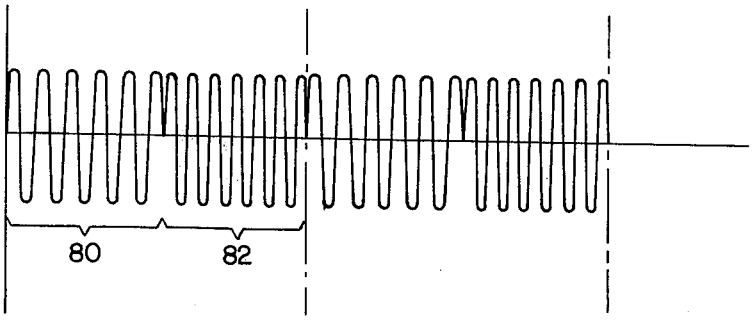
In FIG. 6 there is illustrated an amplitude modulated speed control signal, including a speed control tone frequency and a predetermined occupancy detection frequency.

In FIG. 6 there is illustrated an amplitude modulated speed control signal, including a speed control frequency tone modulated signal 80 and a predetermined occupancy detection frequency modulated signal 82. The speed control tone frequency signal could be one of the above six specified tone frequency signals ranging from 5.0 hertz up to 16.8 hertz. The predetermined occupancy detection frequency is one of the carrier frequencies one through four provided to minimize cross talk between adjacent signal block speed coded signals.

Figure 7:
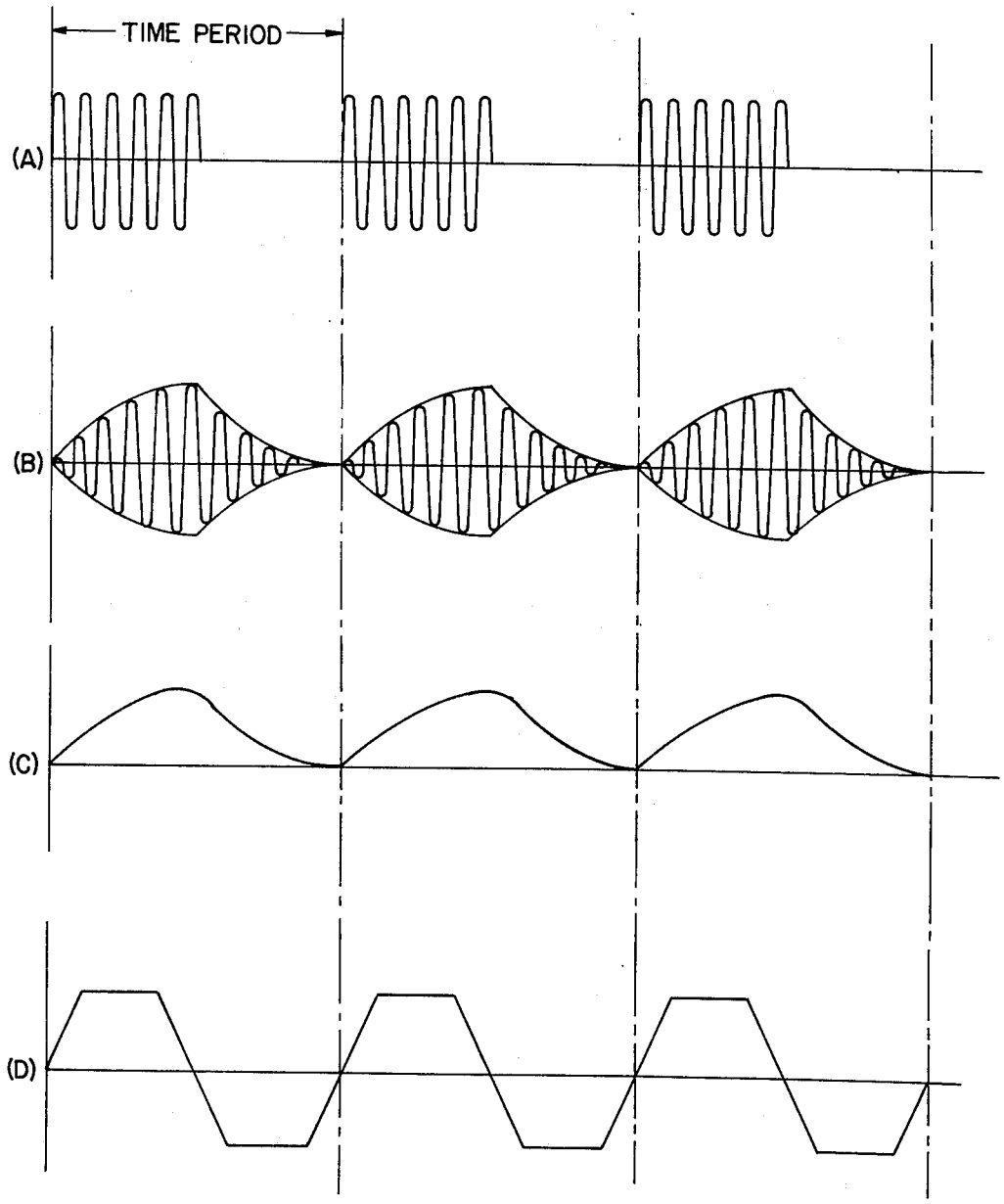
In FIG. 7 there are illustrated the output signals provided by respective element of the train vehicle protection apparatus shown in FIG. 1.

In FIG. 7 there are illustrated the output signals provided by the respective elements of the train vehicle protection apparatus shown in FIG. 1. In FIG. 7A there is shown the amplitude modulated speed code signal received from the antenna 22. In FIG. 7B there is shown the output signal from the vital filter 26. In FIG. 7C there is shown the approximate output from the nonlinear detector 28, including an indication of the frequency tone time period. In FIG. 7D there is shown the output from the frequency to analog converter 30.

Figure 8:
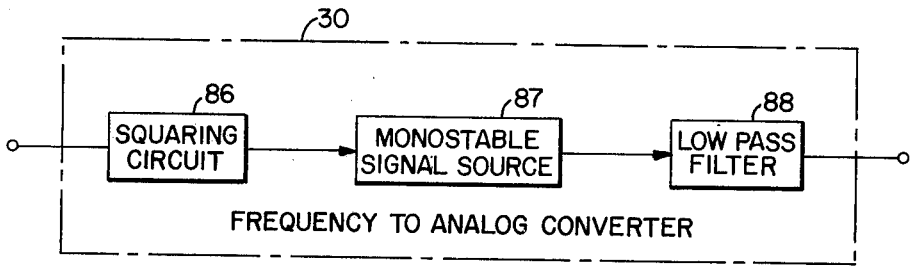
In FIG. 8 there is illustrated the operation of the frequency to analog converter shown in FIG. 1.
Figure 9:
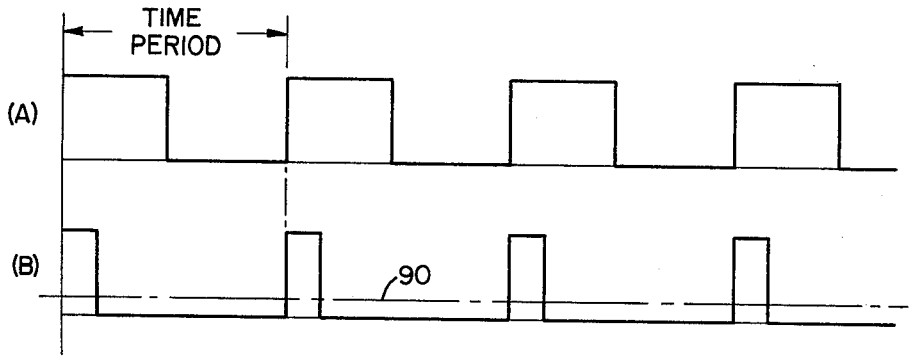
In FIGS. 9A and 9B there is illustrated the operation of the frequency to analog converter shown in FIG. 1 in relation to a first speed control tone frequency.
Figure 10:
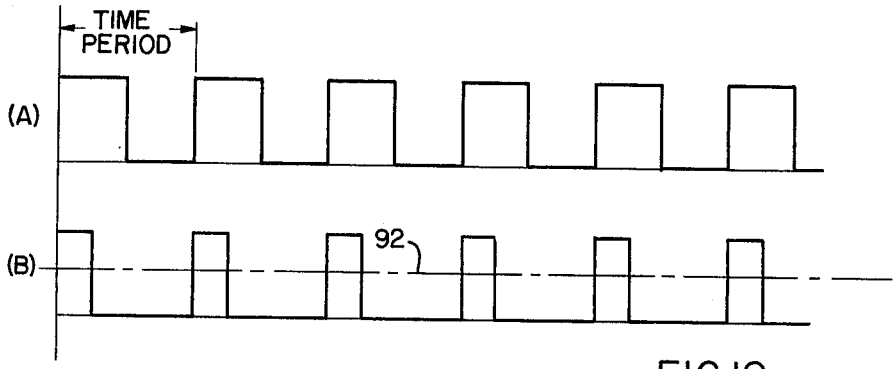
In FIGS. 10A and 10B there is illustrated the operation of the frequency to analog converter shown in FIG. 1 in relation to a second speed control tone frequency.

As shown in FIG. 8, the recovered speed code frequency tone goes into a squaring circuit 86 provided within the frequency to analog converter 30, and the output is substantially a square wave as shown in FIG. 7D. This is applied to a monostable signal source 87 and then to a low pass filter 88, with the output of the monostable 87 being shown in FIG. 9B in relation to the output signal from the squaring circuit 86 shown in FIG. 9A. A constant width pulse is provided in FIG. 9B for each rising edge of the individual square waves shown in FIG. 9A. The frequency tone time period as shown in relation to FIGS. 9A and 9B for a first speed frequency code tone, and a different tone period is shown for the purpose of illustration in relation to FIGS. 10A and 10B for a second speed code frequency tone. An average direct current signal level 90 as shown in FIG. 9B is provided to one input of the comparator 32. In relation to the higher frequency tone shown in FIGS. 10A and 10B having more pulses and thusly a shorter frequency tone time period, it should be noted that the average direct current signal level 92 is higher than the lower frequency tone signal level 90 shown in FIG. 9B.

The square wave speed code signal from the speed frequency tone source 10 is passed through a similar frequency to analog converter 34 as shown in FIG. 1, which includes a squaring circuit, a monostable signal source and a low pass filter to provide a second direct current level signal that can be compared with the first direct current level signal from the frequency to analog converter 30. These first and second direct current level signals are both applied to comparator 32.

Figure 11:
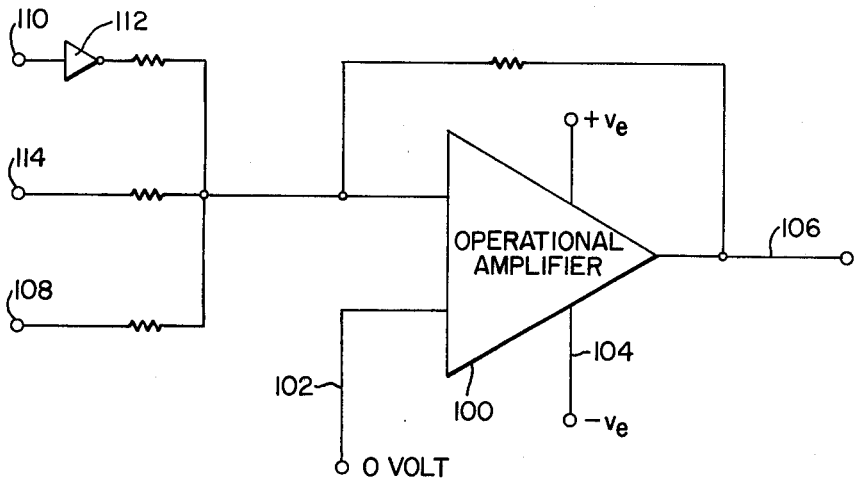
In FIG. 11 there is illustrated a suitable form of the comparator shown in FIG. 1.

In FIG. 11 there is shown a well known summing operational amplifier apparatus 100 suitable to perform the desired signal comparison operation, including a zero volt reference input 102 and a minus volt input 104 and an output 106. The first direct current level signal from the frequency to analog converter 30 is applied to an input 108 and a second direct current level signal from the frequency to analog converter 34 is applied to an input 110 passing through an inverting amplifier 112, to the operational amplifier 100. The operational amplifier is selected to have a high gain characteristic after the feedback, such as is provided by a Fairchild 709 integrated circuit amplifier device. The gain is defined as a ratio of the feedback resistance to the input resistance, and is in the order of one or two hundred.

If the first level signal applied to input 108 is substantially the same as a second level input applied to the input 110, these signals balance each other and the operational amplifier 100 will have a substantially zero output. A third input 114 receives the carrier signal on connection 57 shown in FIG. 1, and this carrier signal is in accordance with the filter output waveform shown in FIG. 7B. It should be understood that a suitable tracer signal could be substituted here, as well known to persons skilled in this art with a low level signal just sufficient to drive the operational amplifier through its full dynamic range of operation being desired to switch the amplifier operation and provide an AC output signal when the compared input signals are substantially the same and in balance. The output of the operational amplifier 100 is connected to a vital relay driver 36 for determining the operation of an occupancy indicated vital relay 38 as shown in FIG. 1. This vital relay 38 could supply an occupancy indication signal $I_n$ to a speed encoder 40. If a first train vehicle occupancy is detected in relation to signal block N, it could be desired that the occupancy indication signal $I_n$ would establish a zero speed code to control a succeeding and second train vehicle in a previous signal block N-1 for the purpose of protecting the first train vehicle in the signal block N. The output of the operational amplifier 100 is an alternating current signal, which is suitable to drive the well known prior art vital relay devices presently sold for train control application. It is essential that an active alternating current signal be provided for this purpose rather than a direct current signal which is not operationally safe from a failsafe train control operation viewpoint.

If a train vehicle is shorting out the transmitted speed code signal from the source 10 in signal block N, and there is some cross talk signal from an adjacent signal block at a different speed control frequency tone, the signal comparison would indicate that different frequency signals are involved and would indicate a train vehicle occupancy situation.

Thusly, for a small difference in the first level signal applied to input 108 as compared to the second level signal applied to input 110, the high gain amplifier 100 will be driven into saturation either positive or negative and the carrier signal applied to input 114 will now be unable to switch the amplifier 100. Therefore, an active output will not be provided by the amplifier 100 under the latter condition of operation and the vital relay driver 36 will not be driven as required for the vital relay 38 to be picked up and this will indicate there is a train vehicle occupancy in signal block N. A vital relay when deenergized is designed to open by gravity in a very reliable manner. The vital driver is operative such that when no input signal is applied, the driver is designed to not provide an output signal and the vital relay cannot hold up. The vital driver is an alternating current power amplifier that will not oscillate and will not provide an output when no input signal is applied to it. These devices are well known in the BART train control system.

The comparator 32 is shown in FIG. 1 operates with the two direct current inputs, and the small carrier signal results in a full swing of the amplifier when the two direct current inputs are in balance. The small alternating current signal overcomes any minor differences between the two direct current input signals, and as soon as the direct current input signals are not in balance then this unbalance is greater than the small carrier input, such that the output is saturated by the unbalance and stops the alternating current output from the amplifier 100. The comparator 32 is vital in operation and the small carrier signal will go through only when the direct current inputs are in balance or substantially in balance such that the alternating current output is the safe condition of train control operation.

Figure 12:
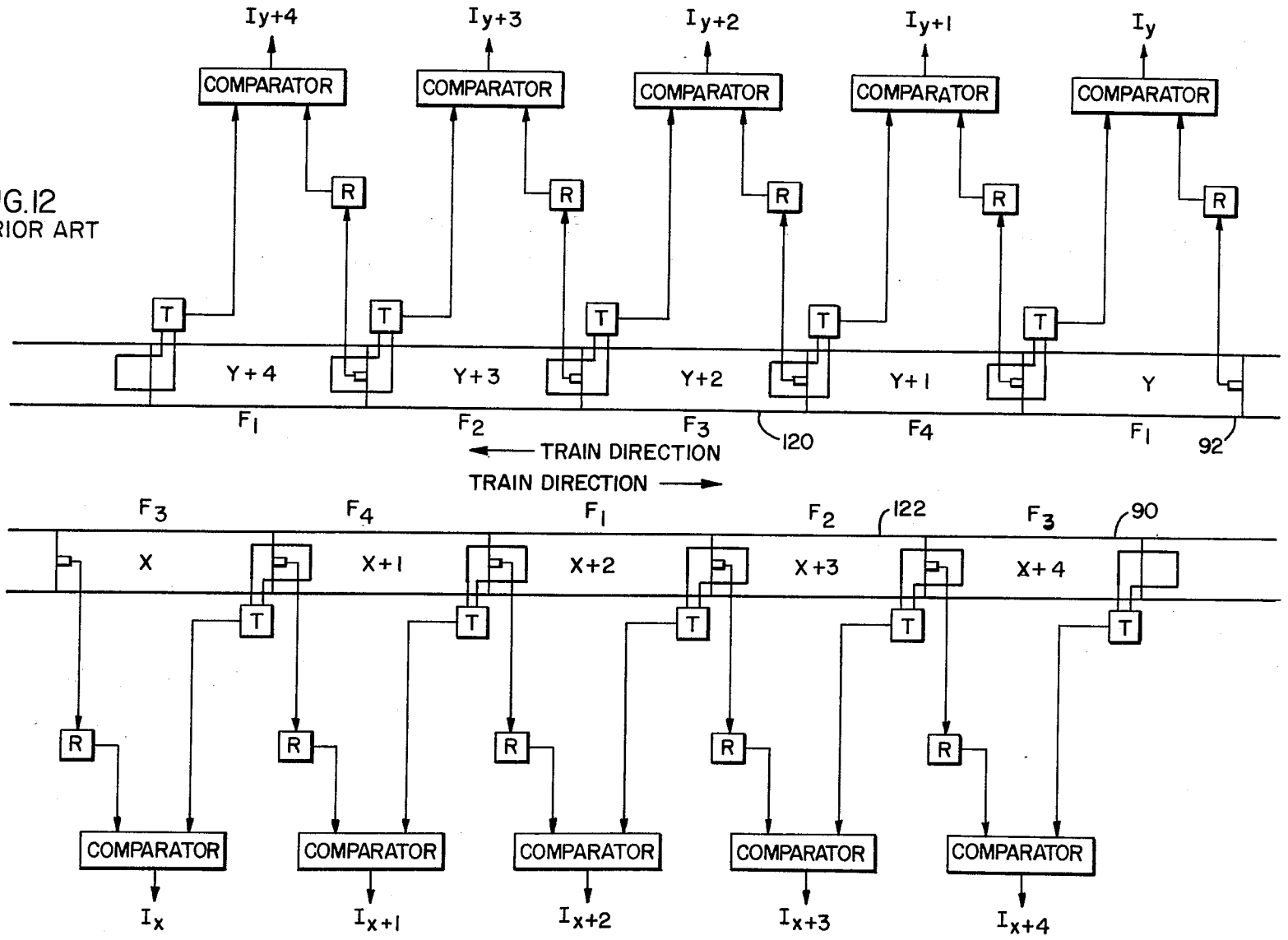
FIG. 12 PRIOR ART
FIG. 12 illustrates a well known track circuit signal block arrangement showing the displacement of the predetermined occupancy detection frequency signals.

In FIG. 12 there is illustrated a well known track circuit signal block arrangement showing the displacement of the predetermined occupancy detection frequency signals F1, F2, and F4, provided to isolate a given signal block in relation to cross talk signals from adjacent signal blocks.

In accordance with the present invention the speed code frequency tone of the received signal is compared with the speed code frequency tone of the transmitted signal to determine vehicle occupancy in a given signal block. The selection of speed code frequency tones in adjacent tracks is such that the likelihood of similar cross talk speed frequency tones presenting any problem here is controlled. A particular signal block has a particular speed code frequency tone corresponding to a desired vehicle speed, for example 40 mph, within that signal block.

In relation to the signal waveform shown in FIG. 6, in the blank portion of each tone period a selected frequency occupancy detection signal is provided. The speed controlled train vehicle does not sense this occupancy detection signal because a train vehicle is only sensitive to the 990 hertz carrier signal with its speed frequency tone amplitude modulation. However, at the wayside the occupancy detection apparatus shown in FIG. 1 is sensitive to a particular occupancy detection signal, which typically is a higher frequency than the speed code frequency tones and may be in the order of 2 kilohertz.

In FIG. 12 the occupancy detection signal frequencies F1, F2, F3 and F4 are illustrated for each of a first vehicle track 120 and a second vehicle track 122. The speed frequency tones modulate both the 990 hertz speed control carrier as well as the higher frequency occupancy detection signal associated with a given signal block. At signal block X, the combined 990 hertz carrier and the F3 occupancy detection signal will be provided. At signal block X + 1, the combined 990 hertz carrier and the F4 occupancy detection signal will be provided. At signal block X + 2, the combined 990 hertz carrier and the F1 occupancy detection signal frequency will be provided, and so forth as shown in FIG. 12. This occupancy detection signal arrangement will substantially avoid any cross talk signal problems between the signal blocks of the respective vehicle tracks since the signal balance and physical separation are selected for this purpose as described in the above referenced U.S. Pat. No. Re. 27,472 of G. M. Thornbooth and the article published in the Westinghouse Engineer for September, 1972 at pages 145–151.

In accordance with the present invention the frequency tone signal received in the track is compared with the transmitted frequency tone signal to see if a particular track circuit signal block is receiving the intended speed code signal transmitted to that signal block. The center frequency of the band pass filter 26 shown in FIG. 1 is in accordance with a selected one of the occupancy detection signals F1, F2, F3 and F4 supplied to a particular signal block. The 990 hertz carrier is interposed with one of the occupancy detection signals, and the filter has signal thresholds to assure that a predetermined signal level in the signal block will be sensed by the band pass filter 26. If some apparatus fails in the occupancy detection apparatus, such that an erroneous higher frequency tone signal and therefore higher speed signal is supplied to a particular signal block, the present control apparatus would indicate a vehicle occupancy for that situation which would be a safe condition of operation.

When transmitting speed command signals into the track of a steel wheel and steel rail system, there is provided a comparison of the command signal sent with that received within a track circuit signal block. The comparison operation serves to establish whether or not the signal block is occupied by a train vehicle. In addition, by comparing the frequency tone code signals in this manner, the safety of train vehicle operation is enhanced by virtually eliminating the possibility of receiving undesired frequency tone code signals from adjacent signal blocks when a particular transmitter fails or track bonds become broken.

The speed frequency tone signal is modulated and transmitted to the track in a normal manner. At the receiver the frequency tone signal is detected and passed on to a frequency to analog converter and then compared with the transmitted frequency tone signal also suitably converted through a similar frequency to analog converter. The respective frequency to analog converter develop constant width pulses from a monostable circuit which are applied to a vital low pass filter to develop a DC signal level proportional to the frequency input. The output signals of the respective converters are equal for corresponding frequency signal inputs and are applied in opposite polarity. These two signals are applied to the comparator which is a high gain amplifier together with the modulated received signal. If the converter outputs balance at the input to the comparator, the modulated output is available for detection and input to a suitable occupancy driver. Any frequency signal error, component failure or occupancy will throw the train control system out of balance and remove the output signal applied to the vital relay driver 36.

We claim:

1. In control apparatus for a train vehicle operative with a track divided into a plurality of signal blocks, the combination comprising means for supplying a predetermined frequency control signal to one of said signal blocks, means for receiving a control signal from said one signal block, means for converting said supplied signal into a first representative signal, means for converting said received signal into a second representative signal, and means for comparing said first representative signal with said second representative signal to determine the occupancy of said one siignal block by a train vehicle.

2. The control apparatus of claim 1, with said means for comparing including a high gain summing amplifier operative to provide an output signal when said first representative signal compares substantially the same as said second representative signal.

3. The control apparatus of claim 1, including speed encoder means for controlling the supply of said predetermined frequency control signal in response to the determination of said occupancy by said means for comparing.

4. The control apparatus of claim 1, with said first representative signal having a first analog value in accordance with the frequency of said supplied signal and with said second representative signal having a second analog value in accordance with the frequency of said received signal.

5. The control apparatus of claim 4, with said means for comparing being operative to indicate a train vehicle occupancy in said one signal block when said first analog value is substantially different than said second analog value.

6. In a control system for determining the occupancy by a train vehicle in one signal block of a conductive track including a plurality of signal blocks, the combination comprising means for supplying a frequency tone speed control signal to said one signal block, means for sensing the presence of a frequency tone speed control signal in said one signal block, means for converting said speed control signal supplied to said one signal block into a first converted signal, means for converting said speed control signal sensed in said one signal block into a second converted signal, and means for indicating the occupancy by said train vehicle of said one signal block by comparing said first converted signal with said second converted signal.

7. The control system of claim 6, with said first converted signal having an analog value determined by the frequency of said speed control signal supplied to said one signal block and with said second converted signal having an analog value determined by the frequency of said speed control signal sensed in said one signal block.

* * * * *

UNITED STATES PATENT AND TRADEMARK OFFICE

CERTIFICATE OF CORRECTION

PATENT NO. : 3,958,781

DATED : May 25, 1976

INVENTOR(S) : David H. Woods and Larry W. Anderson

It is certified that error appears in the above-identified patent and that said Letters Patent are hereby corrected as shown below:

On the cover sheet

Change Item (75) to read -- [75] Inventors: David H. Woods, Pittsburgh, PA; Larry W. Anderson, Sao Paulo, Brazil --.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*